US006007433A

United States Patent [19]

Helmstetter et al.

[11] Patent Number: 6,007,433

[45] Date of Patent: Dec. 28, 1999

[54] SOLE CONFIGURATION FOR GOLF CLUB HEAD

[75] Inventors: Richard C. Helmstetter, Rancho Santa Fe; D. Clayton Evans, Vista, both of Calif.

[73] Assignee: Callaway Golf Company, Carlsbad, Calif.

[21] Appl. No.: 09/054,155

[22] Filed: Apr. 2, 1998

[51] Int. Cl.[6] ..... A63B 53/04

[52] U.S. Cl. ..... 473/328; 473/345

[58] Field of Search ..... 473/324, 328, 473/345, 344, 349, 350

[56] References Cited

U.S. PATENT DOCUMENTS

| | | |
|---|---|---|
| D. 95,549 | 2/1935 | Jansky . |
| D. 225,419 | 12/1972 | Mills . |
| D. 307,783 | 5/1990 | Iinuma . |
| D. 318,087 | 7/1991 | Helmstetter . |
| 1,167,106 | 1/1916 | Palmer . |
| 1,568,888 | 1/1926 | Dunn . |
| 1,582,836 | 4/1926 | Link . |
| 1,619,566 | 3/1927 | Crankshaw . |
| 1,658,581 | 2/1928 | Tobia . |
| 1,669,482 | 5/1928 | Miller . |
| 1,868,286 | 7/1932 | Grieve . |
| 1,916,792 | 7/1933 | Hadden . |
| 1,946,208 | 2/1934 | Hampton . |
| 2,041,676 | 5/1936 | Gallagher . |
| 2,087,685 | 7/1937 | Hackney . |
| 2,201,638 | 5/1940 | Theibault, Sr. . |
| 2,460,435 | 2/1949 | Schaffer . |
| 2,960,338 | 11/1960 | Havey et al. . |
| 3,212,783 | 10/1965 | Bradley et al. . |
| 3,761,095 | 9/1973 | Thompson . |
| 3,815,921 | 6/1974 | Turner . |
| 3,819,181 | 6/1974 | Mills . |
| 3,976,299 | 8/1976 | Lawrence et al. . |
| 4,214,754 | 7/1980 | Zebelean . |
| 4,313,607 | 2/1982 | Thompson . |
| 4,322,083 | 3/1982 | Imai . |
| 4,332,388 | 6/1982 | Crow . |
| 4,432,549 | 2/1984 | Zebelean . |
| 4,511,145 | 4/1985 | Schmidt . |
| 4,681,321 | 7/1987 | Chen et al. . |
| 4,809,977 | 3/1989 | Doran et al. . |
| 4,854,581 | 8/1989 | Long . |
| 4,872,685 | 10/1989 | Sun . |
| 4,930,781 | 6/1990 | Allen . |
| 5,042,806 | 8/1991 | Helmstetter . |
| 5,067,715 | 11/1991 | Schmidt et al. . |
| 5,180,166 | 1/1993 | Schmidt et al. . |
| 5,240,252 | 8/1993 | Schmidt et al. . |
| 5,271,620 | 12/1993 | Moriguchi et al. . |
| 5,273,283 | 12/1993 | Bowland ..... 473/338 |
| 5,301,945 | 4/1994 | Schmidt et al. . |
| 5,480,152 | 1/1996 | Schmidt et al. . |
| 5,547,188 | 8/1996 | Dumontier et al. . |
| 5,573,469 | 11/1996 | Dekura . |

FOREIGN PATENT DOCUMENTS

| | | |
|---|---|---|
| 1476889 | 6/1977 | United Kingdom . |
| 2100993 | 1/1983 | United Kingdom . |
| 2225726 | 6/1990 | United Kingdom . |
| 2230459 | 10/1990 | United Kingdom . |

*Primary Examiner*—Kien T. Nguyen
*Attorney, Agent, or Firm*—Joseph H. Lee; Thomas R. Weber; Michael A. Catania

[57] ABSTRACT

A sole configuration for a golf club head that provides the benefits of a sole configuration incorporating a medial ridge design. The medial ridge divides the sole into a toe and heel section. The sole further comprises a first and a second recess in the toe and heel sections respectively, wherein the first and second recesses are downwardly convex thereby allowing for the center of gravity of the golf club head to be positioned lower than in a golf club head having recesses that are downwardly concave. The first recess has a horizontal concavity that is in an opposite direction from the concavity of the second recess.

8 Claims, 4 Drawing Sheets

SOLE CONFIGURATION FOR GOLF CLUB HEAD

FIELD OF THE INVENTION

The present invention relates to golf clubs, and more specifically to a unique configuration for a sole of a golf club head which is designed to lower the center of gravity of the golf club head.

BACKGROUND OF THE INVENTION

It is understood by those of ordinary skill in the art that golf clubs are typically classified into three main categories: wood-type golf clubs, iron-type golf clubs and putters. The terms "wood" and "iron" are used to refer to a type of golf club for performing specific functions, and are not used to limit the respective categories to specific materials. In fact, present day wood-type golf clubs, iron-type golf clubs and putters are manufactured using various materials such as wood, iron, stainless steel, titanium, tungsten, aluminum, composites, plastics, ceramics and the like.

In a wood-type golf club head, the bottom wall, also commonly referred to as the sole, can incorporate the many different design philosophies of various designers and manufacturers. Examples of existing sole configurations include soles having a smooth planar surface, a rounded downwardly convex surface, a surface with raised rails, or a surface having one or more recesses. One such design is that of a soleplate comprising a medial ridge extending from the front section of the soleplate near the face to the rear section of the soleplate. The soleplate further comprises downwardly concave recesses in the toe and heel sections, as shown and described in U.S. Pat. Nos. 5,240,252; 5,301,945; and 5,470,069; the complete disclosures of these three patents of which are herein incorporated by reference. This previous soleplate was designed with a medial ridge to ease the club head through the grass or turf prior to impact with a golf ball, while the downwardly concave recesses improved the player's ability to hit a golf ball from various sidehill lies. While this soleplate configuration has been considered successful in improving the playability of golf clubs, it is believed that further improvements to playability can be achieved by further lowering the center of gravity of such a golf club head.

SUMMARY OF THE INVENTION

The present invention comprises a unique sole configuration for a golf club head. It is an object of the present invention to provide the benefits of a sole configuration that incorporates a medial ridge design. It is a further object of the present invention to provide the benefits of a sole configuration that incorporates recesses in the toe and heel sections of the sole. An additional object of the present invention is to provide recesses in the toe and heel sections of the sole, wherein the recesses are downwardly convex thereby allowing for the center of gravity to be positioned lower than in a golf club head having recesses that are downwardly concave. It is generally accepted in the art that a lower center of gravity increases the playability of a golf club by enabling a golfer to get a golf ball airborne more easily. Accordingly, by incorporating the benefits derived from the medial ridge soleplate configuration, as disclosed in U.S. Pat. Nos. 5,240,252; 5,301,945; and 5,470,069; while enabling a lower placement of the center of gravity by incorporating downwardly convex recesses, the sole configuration of the present invention provides a golf club head with improved playability.

DETAILED DESCRIPTION OF A PREFERRED EMBODIMENT

Like numbers are used throughout the detailed description to designate corresponding parts of the golf club head of the present invention.

Figure 1:
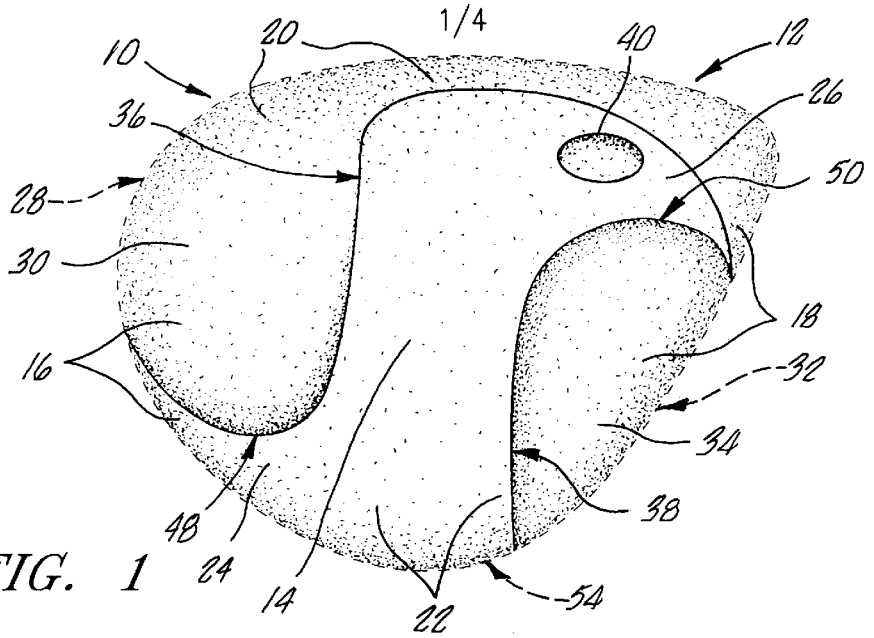
FIG. 1 is a bottom view of a golf club head of the present invention showing a preferred embodiment of a sole configuration comprising a medial ridge with downwardly convex recesses in the toe and heel sections of the golf club head.

FIG. 1 is a bottom view of a golf club head 10 sole 12. The sole 12 comprises a medial ridge 14 that divides the sole 12 into a toe section 16 and a heel section 18. The sole 12 further comprises a front section 20 and a rear section 22. The medial ridge 14 extends from the front section 20 to the rear section 22. The toe, heel, front and rear sections, 16, 18, 20 and 22 respectively, are meant to describe general sections of the golf club head 10 and may overlap one another. The medial ridge 14 has a first lateral extension 24 and a second lateral extension 26. The first lateral extension 24 extends from the rear section 22 of the medial ridge 14 in a direction toward the toe section 16. The second lateral extension 26 extends from the front section 20 of the medial ridge 14 in a direction toward the heel section 18. The medial ridge 14, the first lateral extension 24 and a first outer periphery 28 of the toe section 16 of the sole 12 define a first downwardly convex recess 30. The first downwardly convex recess 30 has a curvature that is convex in a vertical plane, i.e., from the sole 12 to a crown 46, or downwardly convex. The medial ridge 14, the second lateral extension 26 and a second outer periphery 32 of the heel section 18 of the sole 12 define a second downwardly convex recess 34. The second downwardly convex recess 34 has a curvature that is convex in a vertical plane, i.e., from the sole 12 to the crown 46, or downwardly convex. A first inner periphery 36 is defined by the medial ridge 14 and the first lateral extension 24. The first inner periphery 36 has a shape that is concave primarily toward the front and secondarily toward the toe section, 20 and 16 respectively, in a horizontal plane, i.e. from the front section 20 to the rear section 22, or forwardly concave. A second inner periphery 38 is defined by the medial ridge 14 and the second lateral extension 26. The second inner periphery 38 has a shape that is concave primarily toward the rear and secondarily toward the heel section, 22 and 18 respectively, in a horizontal plane, i.e., from the rear section 22 to the front section 20, or rearwardly concave.

In a preferred embodiment, the sole 12 further comprises a sole borethrough 40. As better shown in FIGS. 1, 2 and 5, a preferred embodiment of the golf club head 10 of the present invention comprises a borethrough shaft receiving tube 44 that extends from the crown 46 through to the sole 12. A crown borethrough 42 receives a shaft (not shown) which extends through the receiving tube 44 and exits the sole borethrough 40 on the sole 12.

The transition from the surface level of the medial ridge 14, first and second lateral extensions 24 and 26 to that of the first and second downwardly convex recesses, 30 and 34, may be gradual or stepped. In a preferred embodiment, the transition is a clearly defined step from the surface level of the medial ridge 14, first and second lateral extensions 24 and 26 to the surface level of the first and second downwardly convex recesses 30 and 34. The surface level of the medial ridge 14, first and second lateral extensions 24 and 26, are above that of the surface level of the first and second downwardly convex recesses 30 and 34, i.e., the surface level of the first and second downwardly convex recesses 30 and 34 are displaced vertically and closer toward the crown 46 (as better shown in FIGS. 3, 5 and 6). Stated differently, when viewing the golf club head 10 from the bottom view, as shown in FIG. 1, the depth of the first and second downwardly convex recesses 30 and 34 is below the surface level of the medial ridge 14, first and second lateral extensions 24 and 26, i.e., the surface level of the first and second downwardly convex recesses 30 and 34 are displaced vertically and closer toward the crown 46.

In a preferred embodiment, the variation between the surface level of the medial ridge 14, first and second lateral extensions 24 and 26, and the surface level of the first downwardly convex recess 30 is greatest at a first curvature apex 48. The variation between the surface level of the medial ridge 14, first and second lateral extensions 24 and 26, and the surface level of the second downwardly convex recess 34 is greatest at a second curvature apex 50. The variation between the surface level of the medial ridge 14, the first and second lateral extensions 24 and 26, and the surface level of the first and second downwardly convex recesses 30 and 34, are at a minimum at the junction between the first inner periphery 36 and the first outer periphery 28, and between the second inner periphery 38 and the second outer periphery 32, respectively.

One benefit of having the first and second downwardly convex recesses 30 and 34 curved in the downwardly convex direction in conjunction with the overall downward convexity of the sole 12, is to enable the center of gravity to be located even lower than in a golf club head that incorporates recesses which are curved in the downwardly concave direction. The lower center of gravity further enhances the playability of the golf club while the recesses maintain the player's ability to hit off various sidehill lies.

Figure 2:
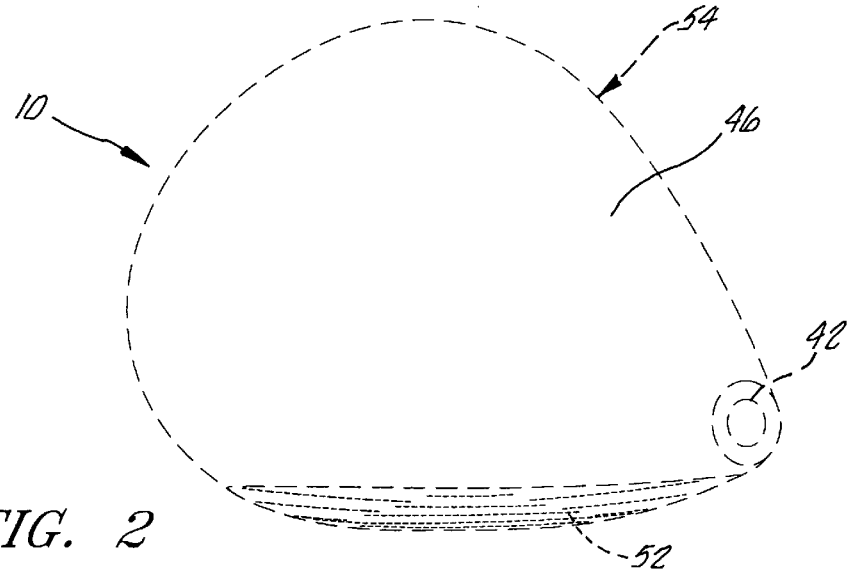
FIG. 2 is a top view of the golf club head.

FIG. 2 is a top view of the golf club head 10. The golf club head 10 comprises a face 52 in the front section 20 of the golf club head 10.

Figure 3:
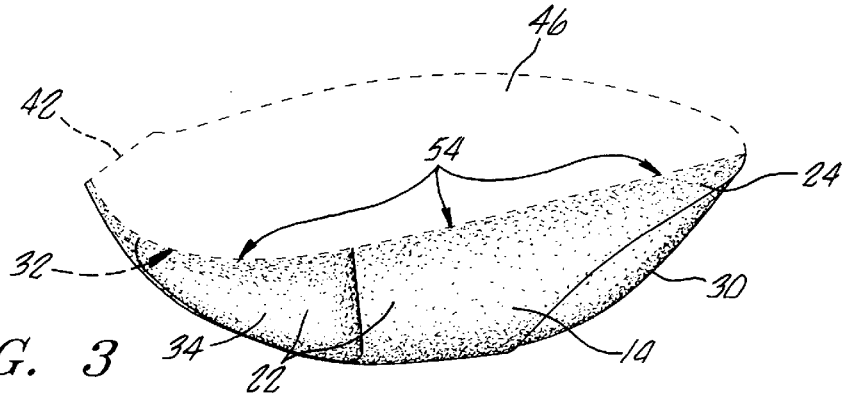
FIG. 3 is a rear view of the golf club head.

FIG. 3 is a rear view of the golf club head 10. This illustration provides a view of a rear junction 54 between the crown 46 and the sole 12. It is to be understood that the first outer periphery 28 (better shown in FIG. 1) comprises a portion of the rear junction 54, and that the second outer periphery 32 comprises a portion of the rear junction 54. Also visible is the first lateral extension 24 extending toward the toe section 16.

Figure 4:
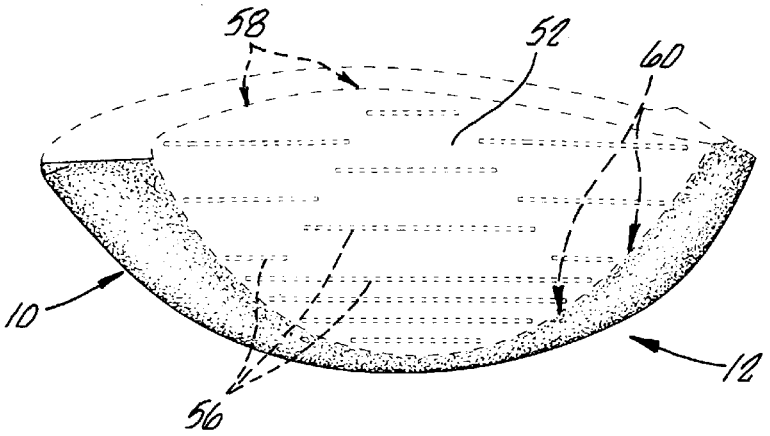
FIG. 4 is a front view of the golf club head.

FIG. 4 is a front view of the golf club head 10 in the golf ball address position, i.e., the sole 12 is closest to the ground and the crown 46 is furthest from the ground. A typical golf club head comprises a scoreline pattern 56 on the face 52 of the golf club head 10. This illustration provides a view of a front top junction 58 between the crown 46 and the face 52, and a view of a front bottom junction 60 between the face 52 and the sole 12. It is to be understood that the first outer periphery 28 (better shown in FIG. 1) further comprises a portion of the front bottom junction 60. In other words, the first outer periphery 28 is comprised of a portion of the rear junction 54 and the front bottom junction 60.

Figure 5:
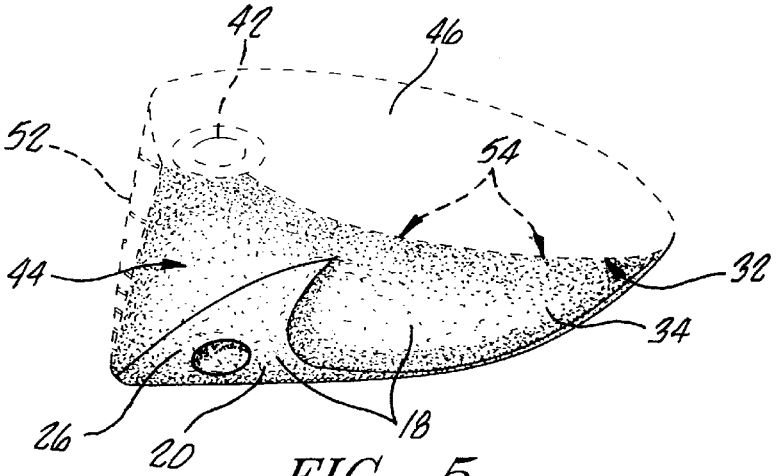
FIG. 5 is a heel view of the golf club head showing a crown borethrough and a sole borethrough, which comprise the ends of a borethrough shaft receiving tube.

FIG. 5 is a heel view of the golf club head 10. This view more clearly shows the second lateral extension 26 extending toward the heel section 18, the second downwardly convex recess 34, and the second outer periphery 32.

Figure 6:
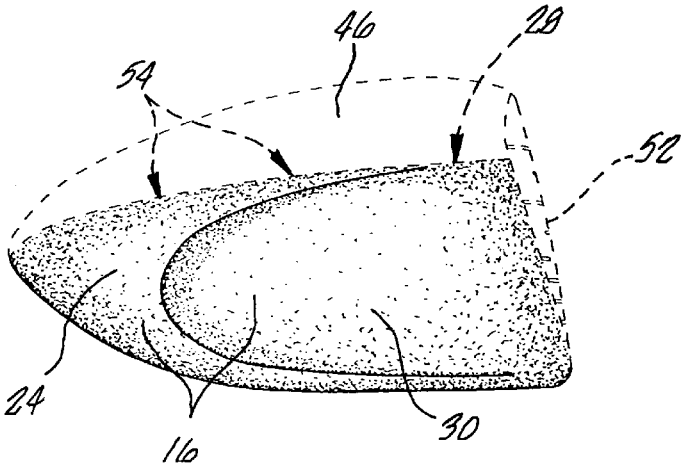
FIG. 6 is a toe view of the golf club head.

FIG. 6 is a toe view of the golf club head 10. This view more clearly shows the first lateral extension 24 extending toward the toe section 16, the first downwardly convex recess 30, and the first outer periphery 28.

Figure 7:
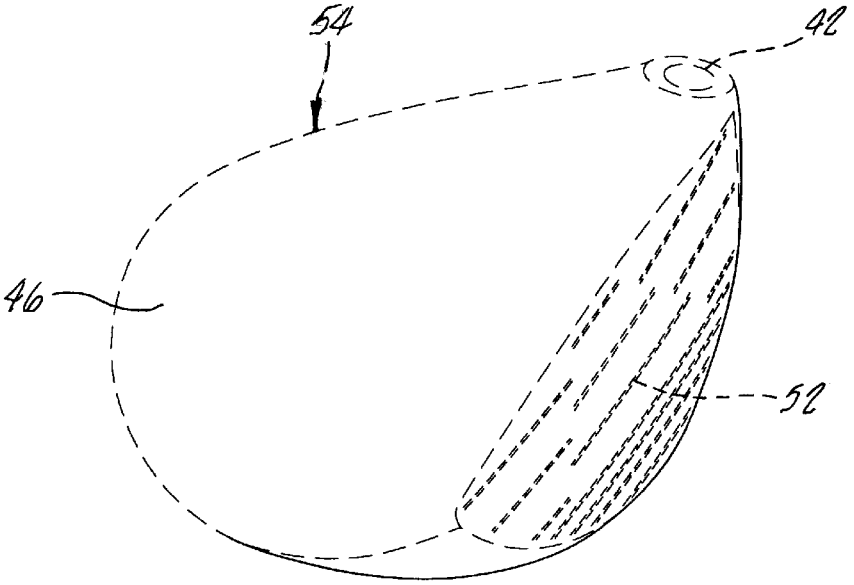
FIG. 7 is a perspective view of the golf club head.

FIG. 7 is a perspective view of the golf club head 10. The sole 12 is better viewed in the other Figures.

FIGS. 8 through 11 are views of an alternative preferred embodiment of a golf club head of the present invention. In FIGS. 8 through 11, the first downwardly convex recess 30 and the second downwardly convex recess 34 are transposed from FIG. 1 as mirror images about the medial ridge 14 axis.

Figure 8:
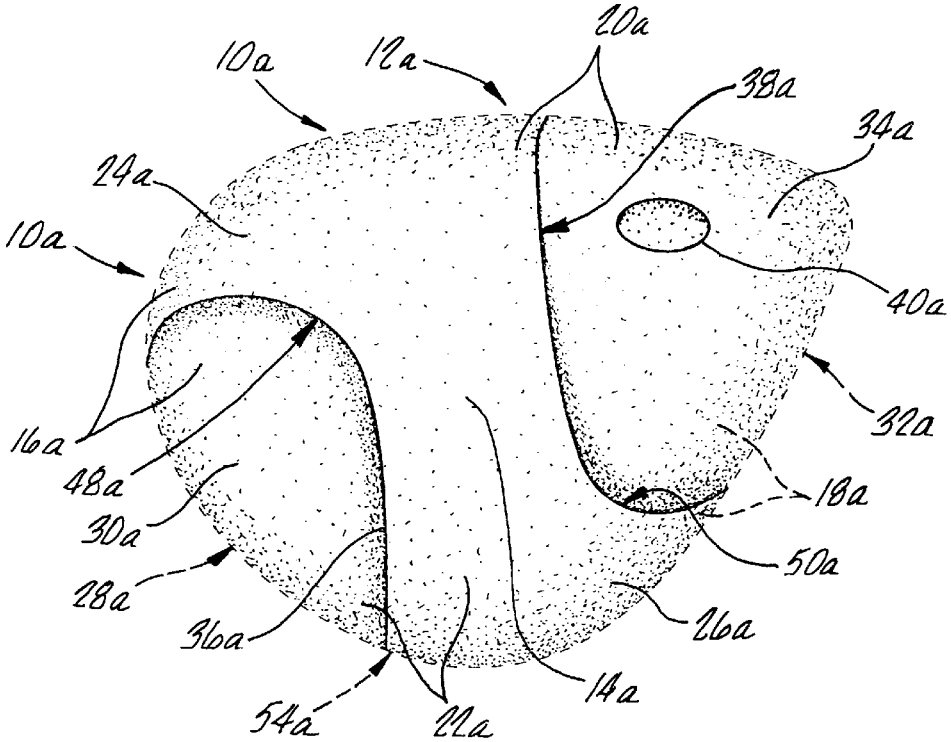
FIG. 8 is a bottom view of a golf club head of the present invention showing an alternative preferred embodiment of a sole configuration comprising a medial ridge with downwardly convex recesses in the toe and heel sections of the golf club head.
Figure 9:
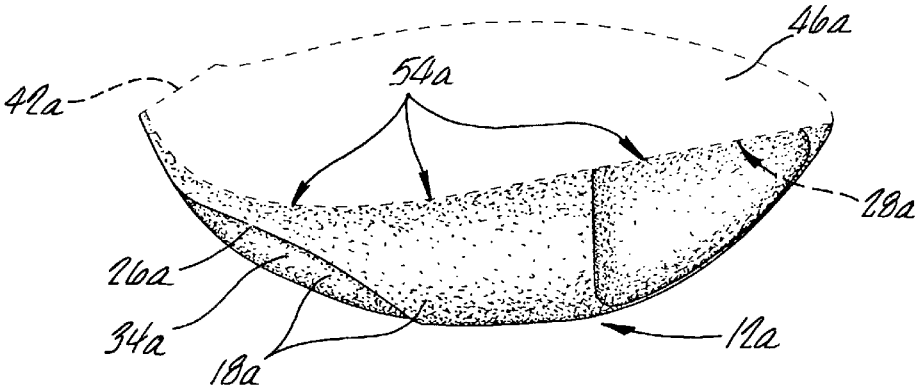
FIG. 9 is a rear view of the alternative preferred embodiment of the golf club head.

FIG. 8 is a bottom view of an alternative embodiment of a golf club head 10*a* sole 12*a*. The sole 12*a* comprises a medial ridge 14*a* that divides the sole 12*a* into a toe section 16*a* and a heel section 18*a*. The sole 12*a* further comprises a front section 20*a* and a rear section 22*a*. The toe, heel, front and rear sections, 16*a*, 18*a*, 20*a* and 22*a* respectively, are meant to describe general sections of the golf club head 10*a* and may overlap one another. The medial ridge 14*a* extends from the front section 20*a* to the rear section 22*a*. The medial ridge 14*a* has a first lateral extension 24*a* and a second lateral extension 26*a*. The first lateral extension 24*a* extends from the front section 20*a* of the medial ridge 14*a* in a direction toward the toe section 16*a*. The second lateral extension 26*a* extends from the rear section 22*a* of the medial ridge 14*a* in a direction toward the heel section 18*a*. The medial ridge 14*a*, the first lateral extension 24*a* and a first outer periphery 28*a* of the toe section 16*a* of the sole 12*a* define a first downwardly convex recess 30*a*. The first downwardly convex recess 30*a* has a curvature that is convex in a vertical plane, i.e., from the sole 12*a* to a crown 46*a* (as shown in FIG. 9), or downwardly convex. The medial ridge 14*a*, the second lateral extension 26*a* and a second outer periphery 32*a* of the heel section 18*a* of the sole 12*a* define a second downwardly convex recess 34*a*. The second downwardly convex recess 34*a* has a curvature that is convex in a vertical plane, i.e., from the sole 12*a* to the crown 46*a*, or downwardly convex. A first inner periphery 36*a* is defined by the medial ridge 14*a* and the first lateral extension 24*a*. The first inner periphery 36*a* has a shape that is concave primarily toward the rear and secondarily toward the toe section, 22*a* and 16*a* respectively, in a horizontal plane, i.e. from the rear section 22*a* to the front section 20*a*, or rearwardly concave. A second inner periphery 38*a* is defined by the medial ridge 14*a* and the second lateral extension 26*a*. The second inner periphery 38*a* has a shape that is concave primarily toward the front and secondarily toward the heel section, 20*a* and 18*a* respectively, in a horizontal plane, i.e., from the front section 20*a* to the rear section 22*a*, or forwardly concave.

In a preferred embodiment, the sole 12*a* further comprises a sole borethrough 40*a*. As better shown in FIG. 10, a preferred embodiment of the golf club head 10*a* of the present invention comprises a borethrough shaft receiving tube 44*a* that extends from the crown 46*a* through to the sole 12*a*. A crown borethrough 42*a* receives a shaft (not shown) which extends through the receiving tube 44*a* and exits the sole borethrough 40*a* on the sole 12*a*.

The transition from the surface level of the medial ridge 14*a*, first and second lateral extensions 24*a* and 26*a* to that of the first and second downwardly convex recesses, 30*a* and 34*a*, may be gradual or stepped. In a preferred embodiment, the transition is a clearly defined step from the surface level of the medial ridge 14*a*, first and second lateral extensions 24*a* and 26*a* to the surface level of the first and second downwardly convex recesses 30*a* and 34*a*. The surface level of the medial ridge 14*a*, first and second lateral extensions 24*a* and 26*a*, are above that of the surface level of the first and second downwardly convex recesses 30*a* and 34*a*, i.e., the surface level of the first and second downwardly convex recesses 30*a* and 34*a* are displaced vertically and closer toward the crown 46*a* (as better shown in FIGS. 9, 10 and 11). Stated differently, when viewing the golf club head 10*a* from the bottom view, as shown in FIG. 8, the depth of the first and second downwardly convex recesses 30*a* and 34*a* is below the surface level of the medial ridge 14*a*, first and second lateral extensions 24*a* and 26*a*, i.e., the first and second downwardly convex recesses 30*a* and 34*a* are displaced vertically and closer toward the crown 46*a*.

In a preferred embodiment, the variation between the surface level of the medial ridge 14*a*, first and second lateral extensions 24*a* and 26*a*, and the surface level of the first downwardly convex recess 30*a* is greatest at a first curvature apex 48*a*. The variation between the surface level of the medial ridge 14*a*, first and second lateral extensions 24*a* and 26*a*, and the surface level of the second downwardly convex recess 34*a* is greatest at a second curvature apex 50*a*. The variation between the surface level of the medial ridge 14*a*, the first and second lateral extensions 24*a* and 26*a*, and the surface level of the first and second downwardly convex recesses 30*a* and 34*a*, are at a minimum at the junction between the first inner periphery 36*a* and the first outer periphery 28*a*, and between the second inner periphery 38*a* and the second outer periphery 32*a*, respectively.

One benefit of having the first and second downwardly convex recesses 30*a* and 34*a* curved in the downwardly convex direction in conjunction with the overall downward convexity of the sole 12*a*, is to enable the center of gravity to be located even lower than in a golf club head that incorporates recesses which are curved in the downwardly concave direction. The lower center of gravity further enhances the playability of the golf club while the recesses maintain the player's ability to hit off various sidehill lies.

FIG. 9 is a rear view of the golf club head 10*a*. This illustration provides a view of a rear junction 54*a* between the crown 46*a* and the sole 12*a*. Also visible is the second lateral extension 26*a* extending toward the heel section 18*a*, and the first outer periphery 28*a*.

Figure 10:
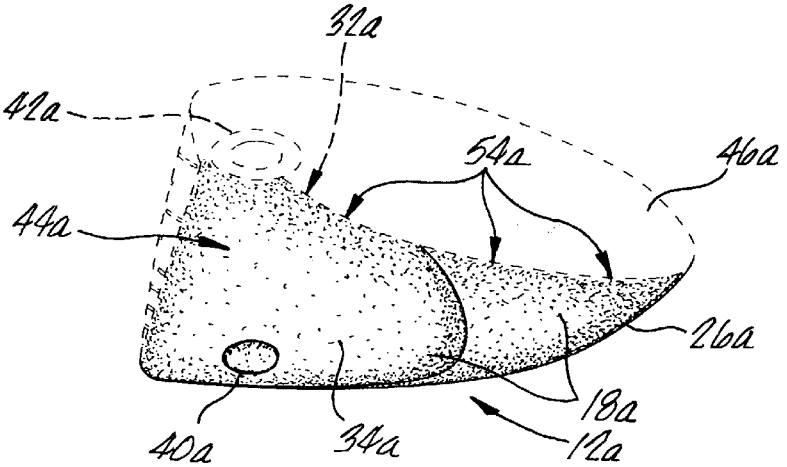
FIG. 10 is a heel view of the alternative preferred embodiment of the golf club head.

FIG. 10 is a heel view of the golf club head 10*a*. This view more clearly shows the second lateral extension 26*a* extending toward the heel section 18*a*, the second downwardly convex recess 34*a*, and the second outer periphery 32*a*.

Figure 11:
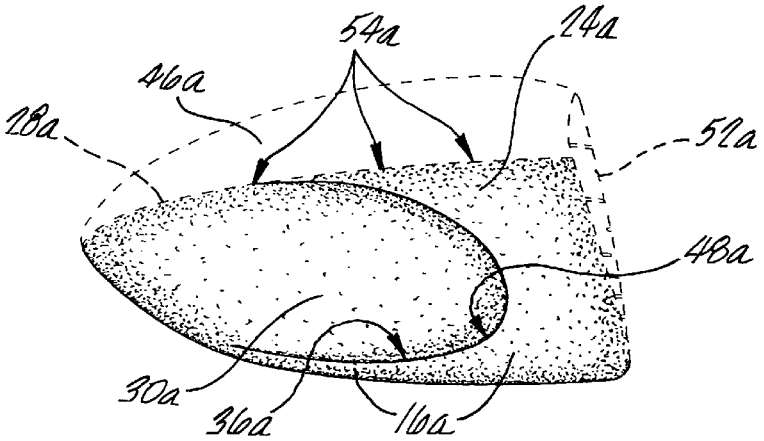
FIG. 11 is a toe view of the alternative preferred embodiment of the golf club head.

FIG. 11 is a toe view of the golf club head 10*a*. This view more clearly shows the first lateral extension 24*a* extending toward the toe section 16*a*, the first downwardly convex recess 30*a*, and the first outer periphery 28*a*.

While preferred embodiments have been discussed and illustrated above, the present invention is not limited to these descriptions or illustrations, and includes all such modifications which fall within the scope of the invention and claim language presented below.

The Figures presented are of two preferred embodiments for a right-handed golfer. It would be obvious to a person of ordinary skill in the art to take the teachings of this invention and apply them to a design for a golf club head for use by a left-handed golfer. Furthermore, the Figures herein illustrate a golf club head having a single predefined face loft. It is understood by those in the art that by varying the loft, the golf club head of the present invention can be used as a driver, or as a fairway wood, and that the sole configuration of the present invention can be incorporated into these various golf club heads having various different face lofts.

What is claimed is:

1. A golf club head comprising:

a body defining a face in a front section, a crown, a sole being downwardly convex, a toe section, a heel section and a rear section, said sole comprising a medial ridge extending from said front section to said rear section and dividing said sole into said toe section and said heel section, said medial ridge comprising a first lateral extension and a second lateral extension, said first lateral extension extending from said rear section of said medial ridge in a direction toward said toe section, said first lateral extension convex from said medial ridge toward said crown, said second lateral extension extending from said front section of said medial ridge in a direction toward said heel section, said second lateral extension convex from said medial ridge toward said heel section, wherein said medial ridge and said first lateral extension define a first convex recess, and said medial ridge and said second lateral extension define a second convex recess, said first convex recess convex from said medial ridge toward said toe section, and said second convex recess convex from said medial ridge toward said crown.

2. The golf club head according to claim 1 wherein a surface level of said first convex recess and said second convex recess is recessed from a surface level of said medial ridge, said first lateral extension and said second lateral extension.

3. A golf club head comprising:

a body defining a face in a front section, a crown, a sole being downwardly convex, a toe section, a heel section and a rear section, said sole comprising a medial ridge having a first lateral extension convex toward said rear section of said crown and a second lateral extension convex toward said heel section, said medial ridge and said first lateral extension defining a first downwardly convex recess and said medial ridge and said second lateral extension defining a second downwardly convex recess, said first downwardly convex recess being located in said toe section, and said second downwardly convex recess being located in said heel section.

4. The golf club head according to claim 3 wherein said first downwardly convex recess is forwardly convex in a horizontal plane, and said second downwardly convex recess is rearwardly convex in a horizontal plane.

5. The golf club head according to claim 4 wherein said first downwardly convex recess is adjacent a front bottom junction between said face and said sole, and said second downwardly convex recess is adjacent a rear junction between said crown and said sole.

6. The golf club head according to claim 5 wherein a surface level of said first downwardly convex recess and said second downwardly convex recess is recessed from a surface level of said medial ridge, said first lateral extension and second lateral extension.

7. A golf club head comprising a body defining a face in a front section, a crown, a sole being downwardly convex, a toe section, a heel section and a rear section, said sole comprising a medial ridge having a first lateral extension convex toward said rear section of said crown and a second lateral extension convex toward said heel section, said medial ridge and said first lateral extension defining a first downwardly convex recess and said medial ridge and said second lateral extension defining a second downwardly convex recess, said first downwardly convex recess being forwardly convex in a horizontal plane and located in said toe section, said second downwardly convex recess being rearwardly convex in a horizontal plane and located in said heel section, said first downwardly convex recess adjacent a front bottom junction between said face and said sole, said second downwardly convex recess adjacent a rear junction between said crown and said sole, and a surface level of said first downwardly convex recess and said second downwardly convex recess being recessed from a surface level of said medial ridge, said first lateral extension and said second lateral extension.

8. A golf club head comprising a body defining a face in a front section, a crown, a sole being downwardly convex, a toe section, a heel section and a rear section, said sole comprising a medial ridge extending from said front section to said rear section, said medial ridge defining a first surface level and dividing said sole into said toe section and said heel section, said medial ridge comprising a first lateral extension and a second lateral extension, said first lateral extension extending from said rear section of said medial ridge in a direction toward said toe section, and said first lateral extension convex from said medial ridge toward said rear section of said crown, said second lateral extension extending from said front section of said medial ridge in a direction toward said heel section, and said second lateral extension convex from said medial ridge toward said heel section, said medial ridge and said first lateral extension defining a first downwardly convex recess having a second surface level, said medial ridge and said second lateral extension defining a second downwardly convex recess having a third surface level, and said second surface level and said third surface level being intermediate said first surface level and said crown.

* * * * *